United States Patent [19]

Schubert

[11] 4,210,327

[45] Jul. 1, 1980

[54] RACKET-MOUNTED TENNIS BALL RETRIEVER

[76] Inventor: Steven M. Schubert, 3629 Warwick, Kansas City, Mo. 64111

[21] Appl. No.: 906,126

[22] Filed: May 15, 1978

[51] Int. Cl.[2] ..... A63B 69/38

[52] U.S. Cl. ..... 273/73 R; 24/204

[58] Field of Search ..... 273/73 R, 73 C, 73 J, 273/162 E; 294/19 R, 19 A; 46/DIG. 1

[56] References Cited

U.S. PATENT DOCUMENTS

| | | | |
|---|---|---|---|
| 266,598 | 10/1882 | Alexander | 294/19 A X |
| 1,960,110 | 5/1934 | Iles | 294/19 A X |
| 2,750,222 | 6/1956 | Borah | 294/19 A |
| 2,968,509 | 1/1961 | Borah | 294/19 A |
| 3,874,666 | 4/1975 | Ross | 46/DIG. 1 |
| 4,114,881 | 9/1978 | Norton | 273/73 R |

FOREIGN PATENT DOCUMENTS

| | | | |
|---|---|---|---|
| 2254275 | 11/1973 | Fed. Rep. of Germany | 273/73 R |
| 480051 | 7/1951 | Italy | 273/73 R |
| 501523 | 11/1954 | Italy | 294/19 A |

*Primary Examiner*—Richard J. Apley

*Attorney, Agent, or Firm*—Schmidt, Johnson, Hovey & Williams

[57] ABSTRACT

The butt of a tennis racket is made concave so as to have a recess into which the periphery of a tennis ball may seat when the butt is pressed against the ball, and within this recess, a section of fabric having countless tiny hooks is located so that, when the ball is seated within the recess, the hooks snag the curly pile periphery of the ball and thereby releasably attach the same to the tennis racket for retrieval purposes. One aspect of the invention involves the way in which improved retentive engagement is made between a hook fabric and its curly pile counterpart, such improvements residing in the way in which the two fabrics are slidingly rubbed against one another to increase their snagging interengagement, even though the two objects employing the fabrics are simply pressed together in a simple direct manner, such as when pressing the butt of a tennis racket against a tennis ball to retrieve the same.

15 Claims, 16 Drawing Figures

RACKET-MOUNTED TENNIS BALL RETRIEVER

This invention relates primarily to a way of adapting a tennis racket to retrieve tennis balls, but also, in certain broader respects, involves improvements in making a secure snagging or interlocking interengagement between hook and curly pile fabrics where the application of force to engage the two fabrics is normally simply a direct pressing of the two fabrics together. These latter aspects, while having significant utility with respect to a tennis ball retriever, are not necessarily so limited inasmuch as they involve primarily the retention and continued interlocking of the fabrics, and thus might be utilized in situations where any number of different objects are simply hung in a suspended condition.

With respect to tennis ball retrieval, I am aware of a product presently marketed by the Port-A-Court Company, of Los Angeles, Calif., under the trademark "GRAB'R" that consists of an adhesive strip containing countless tiny hooks for adherence to the rounded frame at the head of the racket. In order to retrieve the tennis ball, it must first be secured under-foot to keep it from scooting away when the head of the racket is engaged with the ball and twisted to snag the hooks into the pile. Obviously, this arrangement will not work where the ball may be on the opposite side of the net, for example, and the player is unable to reach the ball with his foot in order to hold it stationary while it is being attached to the racket.

Thus, one important object of the present invention is to provide a retriever which works without supplemental assistance from the player's foot or other sources of aid, and thereby not only simplifies the retrieval procedure, but also enables the player to reach into hard-to-get areas, such as on the far side of the net to retrieve balls located in those spots.

A further important object of this invention is to incorporate the retriever into the racket in such a way that it has no adverse effect on the delicate balance of the racket and does not otherwise interfere with the player's freedom to handle the racket as he may so choose during play.

Another important feature of the invention is to design the retriever in the nature of an attachment which can be readily added to existing rackets without a high degree of skill and dexterity required to accomplish installation of the attachment.

A still further important aspect of the invention is to provide an arrangement, not necessarily limited to tennis ball retrievers, which gives improved interlocking engagement of the hook and curly loop fabrics in those situations where the fabrics would normally be interengaged by a simple direct pressing of the two together. In this respect, it is an important consideration to provide for a degree of sliding interengagement of the two fabrics so as to increase the likelihood of achieving a firm snagging interlock therebetween, but without requiring more than a normal direct pressing of the two fabrics against one another.

A still further important aim of the invention is to incorporate the improvements of the foregoing into a racket-mounted tennis ball retriever.

Figure 1:
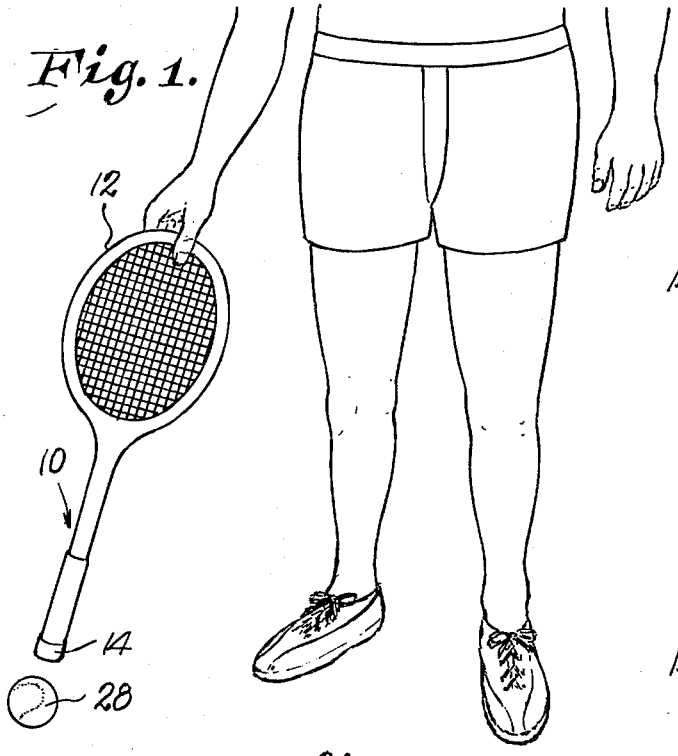
FIG. 1 is a fragmentary, perspective view illustrating the manner in which a racket-mounted retriever in accordance with the present invention is used.

| Other Art of Possible Relevance | |
|---|---|
| 3,032,345 | Lemelson |
| 3,953,030 | Muchnick |
| 3,941,383 | Clarke |
| 3,032,345 | Lemelson |
| 4,006,900 | DiVito |
| 4,029,316 | Clarke |

The racket 10 has a head 12 at one end thereof, and a butt 14 at the opposite end thereof. Dealing first with the embodiment of FIGS. 1–3, the butt 14 has a planar endmost surface 16 that has an adhesive layer 18 bonding the retriever 20 to the butt 14. The retriever 20 includes a block 22 of suitable plastic or rubber material having a flat surface 24 on one side thereof that faces the proximal planar end surface 16 of the butt 14 and receives the adhering action of the adhesive layer 18. The block 22 is generally circular in end plan, and its opposite side is concave to present a recess 26 conforming substantially to the configuration of the arcuate periphery of a tennis ball 28.

The recess 28 presents a dished-out floor 30 having a second adhesive layer 32 thereon which bonds a section 34 of hook fabric onto the floor 30 in conformity with the latter in such a way that the countless small hooks 36 are exposed within the recess 26. It should be noted here that use of the term "fabric" to describe the nature of the hook material is not to be taken in a limiting sense, inasmuch as whether or not the hook material is indeed woven, as in a true fabric, is not significant insofar as the principles of the present invention are concerned. The "fabric" could just as easily be produced from molded plastic, for example. One suitable material has been found to be that sold under the trademark "VELCRO," such being available in many shapes and sizes and well-understood to those skilled in the art.

The tennis ball 28 has a covering of wool or wool-like curly pile fabric that is easily snagged and retained, under proper conditions, by the hooks 36 of the fabric section 34. It has been found, however, that if the fabric section 34 is placed on a convex surface, or even on a planar surface which would be applied tangentially against the ball 28, ineffective snagging of the hooks 36 into the pile loops on the ball 28 will result. One aspect of the present invention involves the way in which the recess 26 allows the ball 28 to seat part of its arcuate periphery into the same and thereby expose a substantial portion of its periphery to the hooks 36. This increased surface exposure is sufficient to enable the hooks 36 to become so snaggingly engaged with the curly pile of the ball 28 that the latter can indeed be lifted from the ground when the racket 10 is used as illustrated in FIG. 1, in which the butt 14 is being pressed downwardly against the ball 28 so that the latter is received within the recess 26.

There is no need to hold the ball 28 with the foot or any other extraneous tool. Consequently, the player can reach over the net and, while grasping the racket 10 by the head 12, can easily retrieve balls that would otherwise be left out of play.

It is apparent that new rackets may be provided with the retriever 20 at the time of initial factory manufacture. In that event, a suitable recess could be provided in the butt 14. However, it is contemplated that the present invention may be useful as an "add-on" item to those many rackets already in existence, in which event the specially configured block 22 becomes useful as a convenient way of obtaining the recess 26 without the requirement of machining the butt 14. It is contemplated that the block 22 may come with the section 34 of hook fabric already attached to the floor 30 through the adhesive layer 32, while a special packet or tube of adhesive for the layer 18 may be also provided in the same kit.

Figure 4:
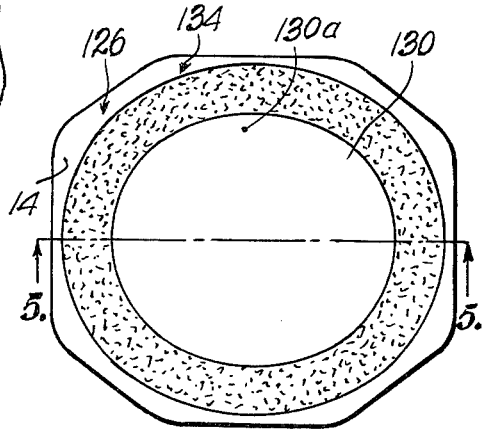
FIG. 4 is a view similar to FIG. 2 on a slightly reduced scale illustrating a second embodiment.
Figure 5:
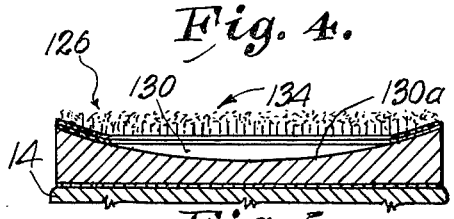
FIG. 5 is a fragmentary, cross-sectional view thereof taken along line 5—5 of FIG. 4.

FIGS. 4 and 5 reveal a second embodiment of the invention to illustrate but a few of the various forms which the section 34 of hook fabric may take within the scope of the present invention. In this embodiment, the section 134 is of annular configuration so as to leave a central, generally circular portion 130*a* of the floow 130 exposed. The annular section 134 is concentric with the floow 130.

Note that the section 134 continues to slope downwardly and inwardly in conformity with the floor 130, thereby not interfering with proper seating of the arcuate periphery of the ball 28 into the recess 126. Although this arrangement represents a significantly smaller amount of interengaged surface area between the hooks of section 134 and the curly pile of the tennis ball 28, nonetheless, the fact that the ball is still well-received within the recess 126 assures that the entirety of the annular section 134 will be in contact with the curly pile of ball 28. If a sufficiently large number of hooks are provided on the section 134, the ball 28 can be retrieved with no difficulty.

Figure 2:
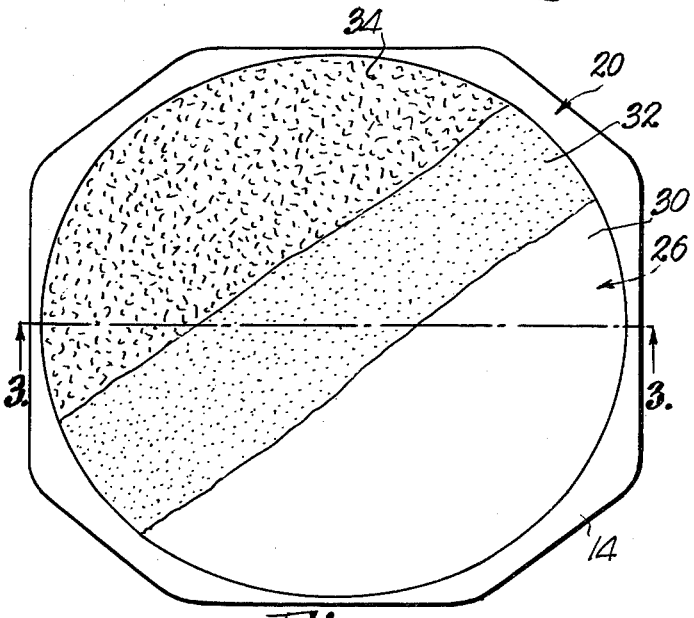
FIG. 2 is an enlarged, end view of the racket with the retriever attached thereto, parts being broken away to reveal details of construction.
Figure 6:
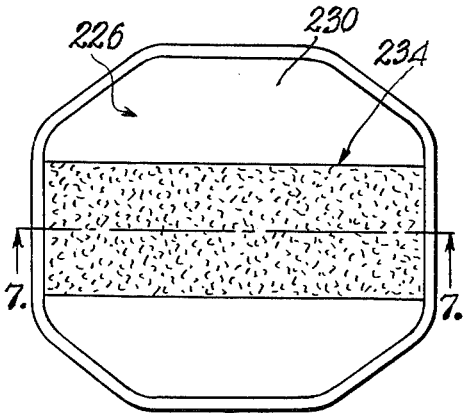
FIG. 6 is a view similar to FIG. 2 on a reduced scale of a third embodiment.
Figure 7:
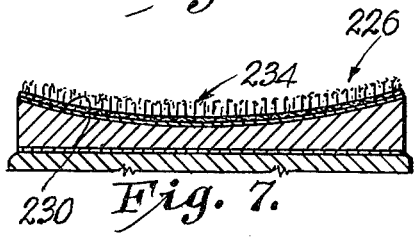
FIG. 7 is a fragmentary, elevational view thereof taken along line 7—7 of FIG. 6.
Figure 3:
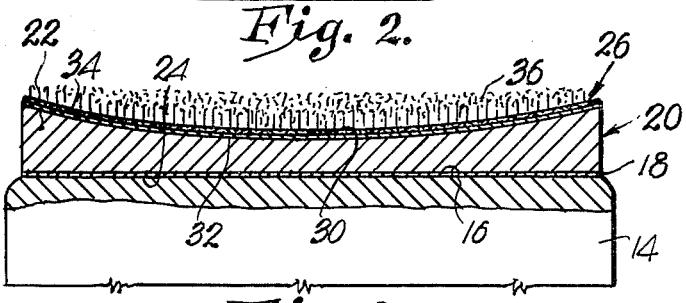
FIG. 3 is a fragmentary, cross-sectional view thereof taken along line 3—3 of FIG. 2.
Figure 8:
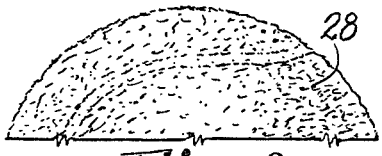
FIG. 8 is a fragmentary, elevational view of a tennis ball illustrating the curly pile on the periphery thereof.

The embodiment of FIGS. 6 and 7 illustrates that, instead of a circular configuration as in FIGS. 2 and 3, or an annular configuration as in FIGS. 4 and 5, the section of hook fabric may simply take the form of a rectangular strip 234. The strip 234 again follows the contour of the floor 230 of the recess 226 so that proper seating of the ball 28 will still be achieved. The exposed areas of the floor 230 on opposite sides of the strip 234, while being devoid of hooks to engage the curly pile of the ball 28, will not detract from the ability of the strip 234 to retain and lift the ball 28 if a sufficiently large number of hooks are provided.

Figure 9:
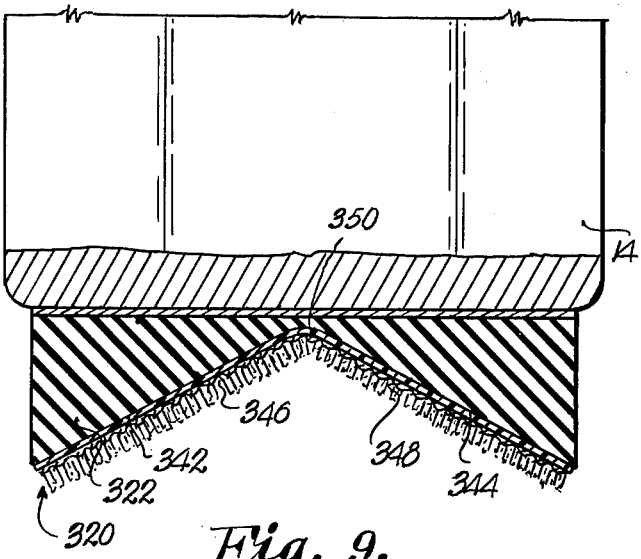
FIG. 9 is a fragmentary view of the butt of a racket shown partially in elevation and partially in cross section, and with a fourth embodiment of the invention shown attached thereto.
Figure 10:
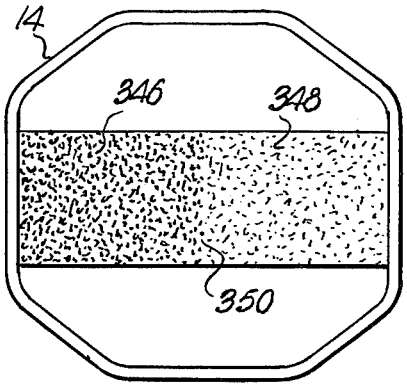
FIG. 10 is an end elevational view thereof on a slightly reduced scale.
Figure 11:
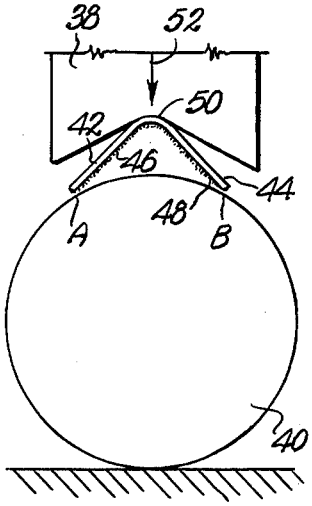
FIGS. 11, 12 and 13 are diagrammatic views illustrating the manner of use of the embodiment of FIGS. 9 and 10.
Figure 12:
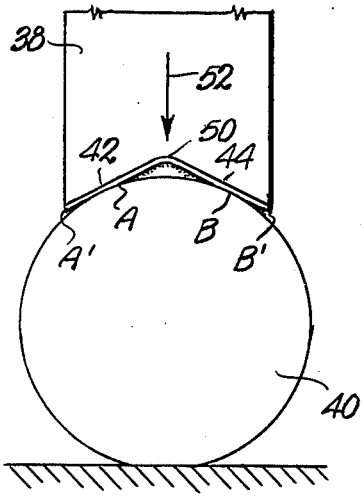
Figure 13:
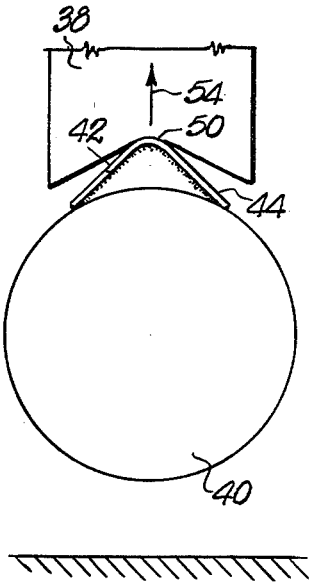

Turning now to the arrangement in FIGS. 9–13, the basic principles involved can perhaps best be illustrated by examining FIGS. 11, 12 and 13. Assuming that a pair of objects 38 and 40 are to be retentively interengaged using interlocking or snagging fabrics as above-described, and assuming further that it is intended for interengagement of the two fabrics to be achieved through a simple pressing of the two objects 38 and 40 against one another, then improved interlocking of the fabrics can be achieved by inducing a relative sliding or rubbing action between the two fabrics during the direct pressing together of the two objects.

To this end, one of the objects 38 may be provided with a pair of converging elements 42 and 44 that support respective sections 46 and 48 of one of the fabrics to be interlocked, it making no difference insofar as the present principles are concerned whether the sections 46, 48 be the hook fabric or the curly pile, loop fabric, The other object 40, of course, will be provided with the remaining fabric not selected for use on the elements 42, 44.

The elements 42 and 44 converge toward a common hinge 50 and may be integrally connected so as to form a unitary piece that is simply secured approximate its middle portion to the object 38. The two elements 42 and 44 are preferably inherently resilient and are normally biased to the position illustrated in FIG. 11, wherein they are disposed obliquely to the path 52 of normal pressing movement of the object 38 toward the object 40, the oblique dispositions of the elements 42 and 44 being, of course, mutually opposite one another as a result of their convergence toward the hinge 50.

It will be noted that in the position of FIG. 11 the outermost tips of the elements 42, 44 are just engaging the object 40 at points A and B, respectively. However, further pressing engagement of the object 38 against the object 40 results in the sections of material 46 and 48 being slid along the periphery of the object 40 as the hinge 50 comes progressively closer to the object 40, and the elements 42, 44 swing back to a more wide-spread condition. Thus, by the time the objects 38 and 40 are fully pressed together, as illustrated in FIG. 12, the tips of the elements 42, 44 will have reached A′ and B′, respectively.

This additional sliding movement between the fabrics of the two objects 38, 40 increases the chances that a secure, snagging interlocking of the two will be achieved. Thus, when the object 38 is then pulled away in the opposite direction indicated by the arrow 54 in FIG. 13, the object 40 is carried therewith, securely attached to the object 38.

This principle may be incorporated into a racket-mounted tennis ball retriever, such an arrangement being illustrated, for example, in FIGS. 9 and 10. There, the butt 14 supports the retriever 320 in the generally same manner as the embodiments of FIGS. 1–7, but in this instance the block 322 is preferably made of some spongy or resilient material that will yield under resistance when force is applied thereto. The converging elements 342 and 344 may be attached to the block 322 by an adhesive layer not shown, or by other suitable means, the elements 342 and 344 in turn having the respective sections 346 and 348 of fabric (preferably the hook fabric) secured thereto by an adhesive layer or by other suitable means. The elements 342 and 344 converge toward the common hinge 350 in the same manner as illustrated in FIGS. 11, 12 and 13.

It is, of course, possible that the backing elements 342 and 344 need not be present in this particular combination as a result of the fact that manufacturing techniques may permit the sections of fabric 346 and 348 to be directly attached to the block 322.

As illustrated in FIG. 10, the fabric sections 346 and 348 may cooperate to present a generally rectangular-appearing strip of material when viewed in plan, similar to the arrangement of FIG. 6. Note also the similarity with regard to the recess associated with the version of FIGS. 6 and 7, and that associated with the version of FIGS. 9 and 10. Both provide an area into which the tennis ball can be received so as to increase the amount of contact area between the two interacting fabrics.

When a tennis ball is pressed into engagement with the fabric sections 346 and 348 in the same manner as illustrated in FIG. 1, the sections 346 and 348 react in the same manner as illustrated in FIGS. 11, 12 and 13, as the block 322 is compressed. Thus, the hinge 350 moves progressively closer and closer to the tennis ball as the sections 346 and 348 swing outwardly into further widespread positions and simultaneously slide along the curly pile of the tennis ball. This significantly increases the chances of achieving a firm and secure interlocking of the tennis ball with the racket, to the end that the racket may provide an extremely handy and reliable means of retrieving not only those balls which are directly beside or in front of the player, but also those which are on the opposite side of the net or in other hard-to-reach places.

Figure 14:
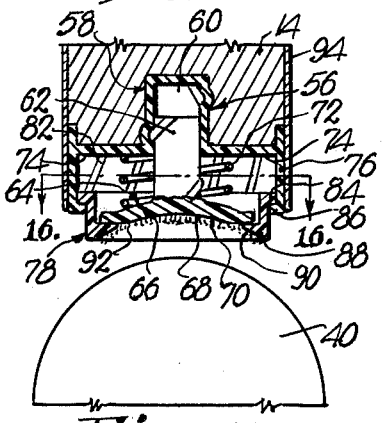
FIG. 14 is a fragmentary vertical cross-sectional view of a fifth embodiment of the invention shown attached to the bracket and in position approaching the surface of a tennis ball.
Figure 15:
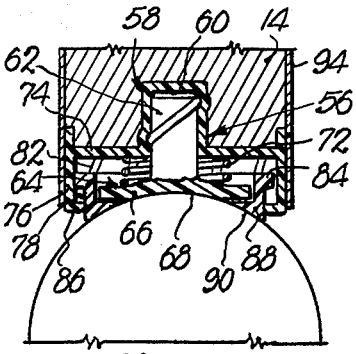
FIG. 15 shows the embodiment of FIG. 14 as it engages the tennis ball.
Figure 16:
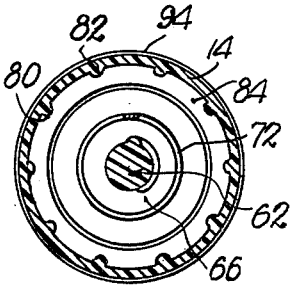
FIG. 16 is a cross-sectional view of the embodiment of FIG. 14 taken substantially along line 16—16 of FIG. 14.

The arrangement of FIGS. 14, 15 and 16 is capable of achieving improved locking engagement of the fabric of the tennis ball or other object 40 with hook fabric associated with the tennis racket. In this regard, a device broadly denoted by the numeral 56 is attached to the butt 14 and includes a part 58 having an internally threaded socket 60 that threadably receives the arbor 62 of a second part 64 of the device 56. Arbor 62 is externally threaded to be matingly received by the socket 60 and has a circular head 66 integral with the arbor 62 at the outer end of the latter. The head 66 is provided with a dished-out surface 68 to which is attached suitable fabric 70. A coil spring 72 surrounds the arbor 62 to yieldably bias the part 64 rotatably out of the socket 60, the spring 72 operating between the inner face of the head 66 on the one hand, and a floor 74 flaring outwardly from the part 58 at the outer termination of the socket 60 on the other hand. A cylinder 76 integral with the floor 74 projects outwardly from the latter and is internally threaded at the same pitch but in the opposite direction as the socket 60 and the arbor 62. A ring component 78 is telescopically received within the cylinder 76 and has a series of circumferentially disposed notches 80, as illustrated in FIG. 16, which matingly receive the threading ribs 82 of the cylinder 76, hence to threadably engage the cylinder 76 and the ring 78.

The ring 78 has an annular, radially outwardly extending lip 84 disposed in overlapping relationship to an inturned limiting shelf 86 at the outermost termination of the cylinder 76 for the purpose of preventing accidential movement of the ring 78 entirely out of the cylinder 76.

As illustrated, the ring 78 circumscribes the head 66 of part 64 and is disposed in concentric relationship therewith such that part 64 and ring 78 share a common axis of rotation. A radially inwardly projecting, annular rim 88 overlaps the proximal marginal periphery of the head 66 such as to limit the outward travel of the part 64, and the rim 88 is provided with a concave surface 90 having essentially the same radius of curvature as the surface 68 of head 66, said surfaces 68 and 90 being substantial continuations of one another when in the condition of FIG. 11. Hook fabric 92 is provided on said surface 90 of the rim 88.

Preferably, the floor 74 is bonded to the butt 14 by means of a suitable adhesive. Additionally, the but 14 and cylinder 76 may be wrapped with a suitable tape 94.

In the use of the embodiment as illustrated in FIGS. 14, 15 and 16, the spring 72 biases the part 64 and the ring 78 to the outer positions illustrated in FIG. 11. When these are engaged with a ball, such as the ball 40, and axial force is applied to the butt 14, the result is a depression of the ring 78 and the part 64. Such depression causes the part 64 to thread into the socket 60 in one direction. The same depression causes the ring 78 to thread into the cylinder 76, but in the opposite rotative direction. Accordingly, the hook fabric 79 on the head 66 and the hooks 92 on the rim 88 slide relatively along the curly pile fabric associated with the ball 40 such as to securely engage and interlock with the same.

Rotation of the part 64 has a tendency to also cause rotation of the ball 40 in the same direction. However, by virtue of the fact that the ring 78 is frictionally engaging the ball 40, this has the effect of resisting or braking such rotation of the ball 40. Hence, there is relative sliding engagement btween the hooks on part 64 and the fabric of the ball 40, resulting in secure interengagement. This is true even if the ring 78 were not designed for counter rotation relative to the part 64, although most desirably, such counter rotation is provided for as herein illustrated.

As illustrated in FIG. 15, the part 64 and the ring 78 simply retract within their respective socket 60 and cylinder 76 as the ball 40 is engaged, whereupon the firmly interlocked ball 40 can be lifted off the ground and manually removed from the racket.

Having thus described the invention, what is claimed as new and desired to be secured by Letters Patent is:

1. Means for the improved retention of a pair of objects, wherein interlocking hook and curly pile fabrics are utilized on the objects to effect said retention, said means comprising:

a mounting for one of the fabrics that produces relative sliding movement between the fabrics so as to interlock the same when the objects are pressed together, said mounting including:

a device associated with one of the objects and supporting said one fabric for rotation in response to said pressing together of the objects; and means for resisting rotation of the other object with said device during said pressing together of the objects whereby to achieve said relative sliding movement of the fabrics.

2. Means for the improved retention of a pair of objects as claimed in claim 1, wherein said device includes a pair of threadably interengaged parts, one of said pairs carrying said one fabric and being threadable into the other part upon the application of axial pressure to said one fabric from the other object.

3. Means for the improved retention of a pair of objects as claimed in claim 2, wherein said one part is provided with means yieldably biasing the same toward said other object.

4. Means for the improved retention of a pair of objects as claimed in claim 1, wherein said resisting means includes a component rotatable in a direction opposite to that of said one fabric during said pressing together of the objects, said component having a surface frictionally engageable with said other object during said rotation of the component.

5. Means for the improved retention of a pair of objects as claimed in claim 4, wherein said component has a section of said one fabric thereon.

6. Means for the improved retention of a pair of objects as claimed in claim 4, wherein said resisting means further includes means threadably receiving said component to effect said rotation thereof.

7. Means for the improved retention of a pair of objects as claimed in claim 6, wherein said device includes a rotatable part circumscribed by said component, said part and said component being movable in unison axially along their common axis of rotation during said pressing together of the objects.

8. Means for the improved retention of a pair of objects as claimed in claim 7, wherein said device further includes another part threadably receiving the first-mentioned part for effecting said rotation thereof.

9. Means for the improved retention of a pair of objects as claimed in claim 8, wherein said first-mentioned part and said component are provided with means yieldably biasing the same toward the other object.

10. In combination with a tennis racket having a butt at one end thereof and a head on the opposite end thereof, a retriever for tennis balls having curly pile on their periphery, said retriever comprising:

a section of hook fabric operable to snag said curly pile of the tennis ball when applied against the same;

means mounting said section on said butt of the racket; and means providing a recess on said butt into which said periphery of the ball may seat while snagged by said section of hook fabric whereby the racket may be grasped by said head and said butt pressed against the ball to releasably attach the same to the racket for retrieval, said recess providing means including a part having a dished surface, said surface having said fabric section thereon, said part being rotatable upon the application of pressure thereto by pressing the ball against said surface, said retriever further comprising means for resisting rotation of the ball with said part during said application of pressure.

11. In the combination as claimed in claim 10, wherein said part is provided with means threadably receiving the same for effecting said rotation of the part.

12. In the combination as claimed in claim 11, wherein said part is provided with means yieldably biasing the same against said rotation.

13. In the combination as claimed in claim 10, wherein said rotation resisting means includes a surface disposed for frictional engagement with the ball, said surface having hook fabric thereon.

14. In the combination as claimed in claim 13, wherein said surface of the rotation resisting means has means threadably receiving the same to effect rotation thereof in a direction opposite to the direction of rotation of said part.

15. In the combination as claimed in claim 14, wherein said surface of the rotation resisting means circumscribes said part in concentric relationship therewith.

* * * * *